United States Patent [19]

Savageau

[11] 4,095,062

[45] June 13, 1978

[54] STOP-MOTION APPARATUS

[75] Inventor: Richard J. Savageau, Seneca, S.C.

[73] Assignee: Platt Saco Lowell Limited, Helmshore, England

[21] Appl. No.: 720,508

[22] Filed: Sep. 3, 1976

[51] Int. Cl.[2] ..... B65H 25/14; D01G 31/00; D01H 13/16

[52] U.S. Cl. ..... 200/61.13; 19/0.23; 19/0.25; 28/189; 57/81; 200/61.18

[58] Field of Search ..... 19/0.2, 0.25, 0.26, 19/0.23; 57/81; 66/161, 163; 200/61.13, 61.18, 61.41; 335/205; 28/189, 187, 212

[56] References Cited

U.S. PATENT DOCUMENTS

| | | | |
|---|---|---|---|
| 2,553,335 | 5/1951 | Scott | 200/61.18 |
| 2,670,503 | 3/1954 | Anderson | 200/61.41 X |
| 2,712,676 | 7/1955 | McIntyre | 200/61.18 |
| 2,734,956 | 2/1956 | Berker | 200/61.18 |
| 3,305,896 | 2/1967 | Rayfield et al. | 200/61.18 X |
| 3,330,016 | 7/1967 | Smith et al. | 200/61.18 X |
| 3,402,269 | 9/1968 | Gregory | 335/205 X |
| 3,404,524 | 10/1968 | Rajonha et al. | 200/61.18 X |
| 3,462,569 | 8/1969 | Schooley | 335/205 X |
| 3,510,862 | 5/1970 | Bell et al. | 200/61.18 X |
| 3,612,791 | 10/1971 | Porter et al. | 200/61.18 |

*Primary Examiner*—James R. Scott
*Attorney, Agent, or Firm*—Joseph H. Heard

[57] ABSTRACT

The apparatus is particularly adapted for detecting breakage, run-out or excessive slackening of running sliver strands passing from a creel to the drafting rolls of a textile drafting machine, and includes reed switches which are actuable by movement, into proximity therewith, of magnet-carrying members which normally are maintained distal from the switches by engagement with the sliver strands. The reed switches are protectively mounted and are so located with respect to the magnet-carrying members as to minimize the number of reed switches required for operation of the apparatus. The channelled mounting for the reed switches also provides separating vane guides for the adjacent running strands of sliver, the guide walls having rounded end protuberances to effect better separation; both the guide elements and magnet-carrying members being coated with a smooth plastic to obviate snagging of sliver.

12 Claims, 6 Drawing Figures

STOP-MOTION APPARATUS

BACKGROUND OF THE INVENTION

This invention relates to an improved stop-motion apparatus particularly but not necessarily exclusively adapted for detecting breakage, run-out and/or excessive slackening of running sliver strands passing from a creel to the drafting rolls of a textile sliver-drafting machine.

Prior U.S. Patents of possible relevance to the present invention are Nos. 2,553,335, 2,670,503, 2,712,676, 2,734,956, 3,295,170, 3,305,896, 3,330,016, 3,404,524, 3,510,862 and 3,612,791.

There are many different types of stop-motion apparatuses employing a member which is normally maintained in a first position by engagement with a running textile strand and which, in the absence of such engagement, moves to a second position and actuates an electrical circuit. In most of the prior stop-motion apparatuses, actuation of the electrical circuit is effected by closure of electrical switch contacts which are exposed to a greater or lesser extent to the ambient air within the textile mills where such apparatuses are used. This is undesirable since such air frequently contains lint, dust, moisture and the like which detrimentally affects the operation of the exposed switch contacts. In recognition of the foregoing fact, there have also been proposed other stop-motion apparatuses employing switching means, such as glass encapsulated reed contact switches, normally open and actuable by magnetic forces, whose contacts are in an inert gas and not exposed to the ambient air. While glass encapsulated reed switches possess the foregoing advantage, they are, as compared to conventional switches, more subject to damage from accidental impacts which they might receive during use. The foregoing considerations are particularly relevant in connection with a stop-motion apparatus associated with a running array of sliver strands passing from a creel to the drafting rolls of a silver-drafting machine. From the viewpoint of their not being readily affected by lint and the like, the use of glass encapsulated reed switches in such a stop-motion apparatus is desirable. On the other hand, the provision of a separate reed switch in association with each strand of the sliver array would entail significant expense. Moreover, a stop-motion apparatus used for the above-noted purpose inevitably is subjected to some accidental impacts during use, as from engagement by the sliver cans moved to and from the creel area and/or by automatic or manual cleaning devices used for removing lint and the like from such creel area. A further problem is that of snagging of the running sliver strands on contact surfaces of switch or switch actuator members, and/or a movement of the running strands to spaces between such coacting members to provide jamming and strand parting creating an "end down" condition or a failure to maintain the running strands separated from one another when they leave the stop-motion device.

OBJECTS OF THE INVENTION

The primary object of the present invention is the provision of a stop-motion apparatus, particularly adated for use in association with an array of textile sliver strands passing from a creel to the drafting rolls of a textile drafting machine, which is of highly economical, durable and compact construction and whose operation is highly reliable and is not adversely affected by lint, dust, moisture and the like in the ambient air or by accident impacts.

A related and more specific object is the provision of a stop-motion apparatus, of the type described above, employing magnetically-actuable potted and encapsulated reed switches which are arranged therein in such a manner as to minimize the number required and the possibility of their being subjected to impact-damage or to unauthorized tampering during use of the apparatus.

Another related and more specific object is the provision of a stop-motion apparatus which may be quickly and easily installed as a new or replacement unit in association with existing textile machinery, as well as being applicable to new machinery.

SUMMARY OF THE INVENTION

The present invention provides stop-motion apparatus of an improved type particularly adapted for use in association with an array of running sliver strands passing from the creel to the drafting rolls of a textile drafting machine. The apparatus incorporates magnetically-actuable reed switches which are not adversely affected by the lint, dust and similar conditions attendant such usage. The reed switches are so mounted as to minimize their required number and as to be shielded from possible impacts and the like received by the apparatus during use. In its preferred emboidment, the stopmotion apparatus includes elongate protective strand guiding means which extends across the sliver array and which has a plurality of bottomless strand-receiving passages or channels and vane-like strand guiding members in spaced relationship to each other along its length. The reed switches of the apparatus are protectively mounted within and enclosed by alternate ones (every other one) of the vane-like members. Strand engaging members are pivotally mounted above each of the channel passageways for independent pivoted movement between upward first positions, in which the members are maintained by engagement with the sliver strands passing through such passageways, and downward second positions which the members assume in the absence of supportive engagement with the strands. Magnetic means carried by the strand engaging members is so located thereon in relation to the reed switches housed within alternate ones of the vane-like members that each reed switch is actuable by movement to its second position of either of the two strand engaging members immediately adjacent and on either side of it.

In addition to performing other functions, metal structural components of the apparatus may and preferably do serve in lieu of conventional wiring as electrical conductors of a stop-motion circuit of any desired type.

Both the elongate protective strand guiding means and especially its vane-like strand guiding members and also the magnet-bearing strand engaging members have rounded edges and are coated with plastic of sufficient depth so as to provide smooth surfaces to prevent snagging by sliver fibers of the running strands. The free ends of the vane members terminate in protuberances which force adjacent running strands passing through adjacent channels formed thereby into a more positive degree of separation from one another within and upon leaving the apparatus.

DESCRIPTION OF THE DRAWINGS

Other features of the invention will be apparent from the following description of an illustrative preferred embodiment thereof, which should be read in conjunction with the accompanying drawings in which.

DESCRIPTION OF THE PREFERRED EMBODIMENT

Figure 1:
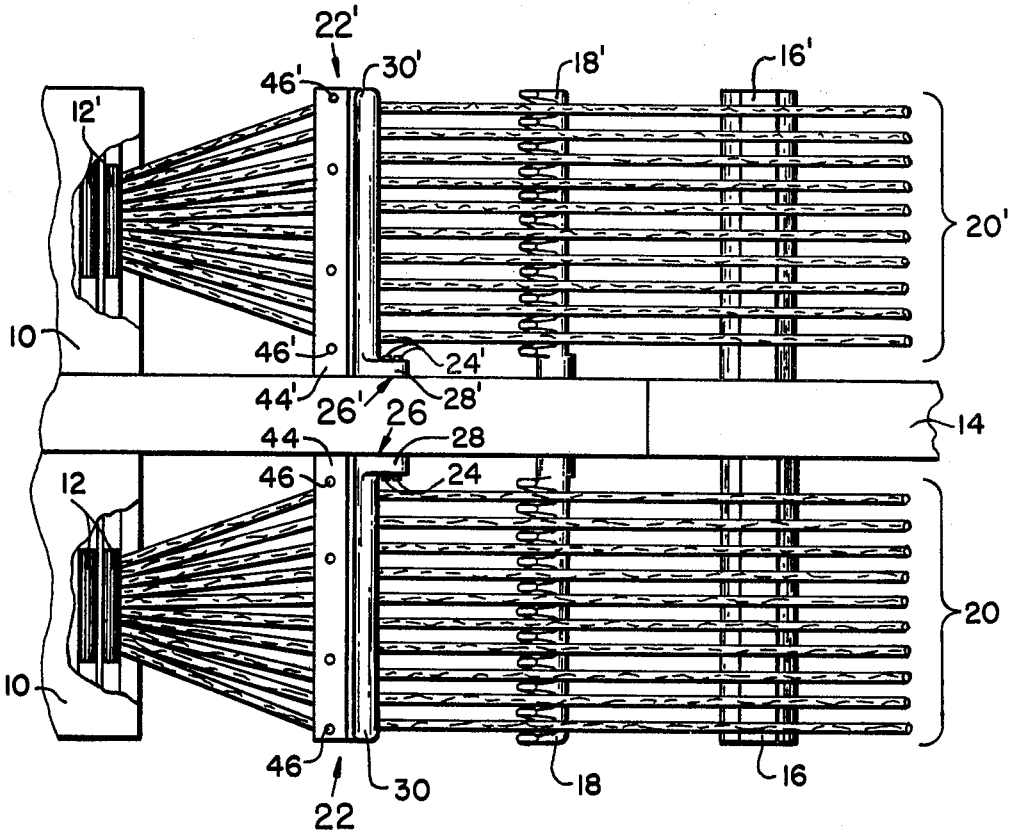
FIG. 1 is a fragmentary top plan view of two sliver arrays entending from a creel to the drafting rolls of a two-delivery sliver drafting machine, and of two stop-motion apparatuses of the present invention in association with respective ones of the sliver arrays.
Figure 2:
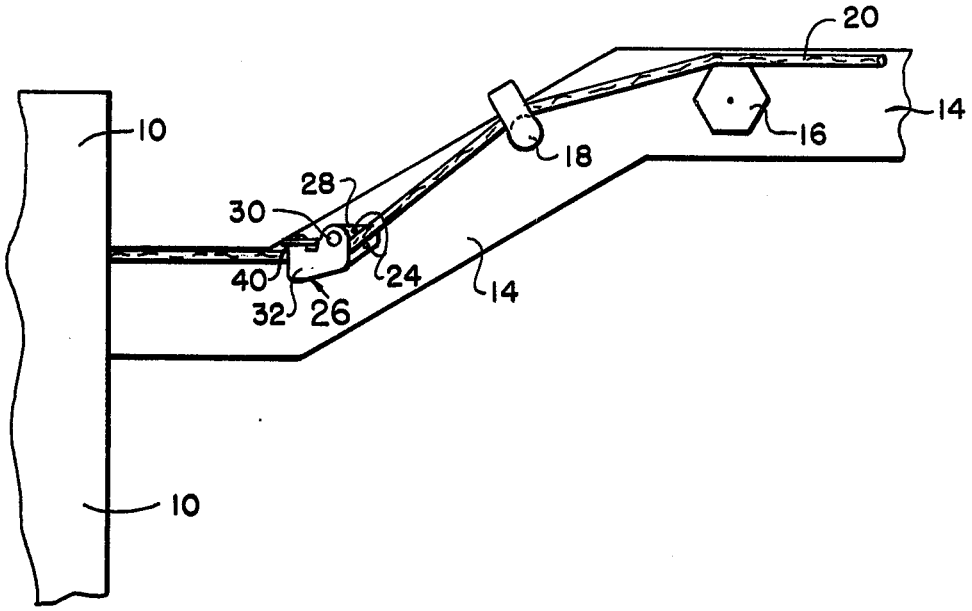
FIG. 2 is a side elevational view of the components of FIG. 1.

FIGS. 1 and 2 of the drawings show fragmentary portions of a textile sliver drafting machine 10, illustratively in the form of a two-delivery draw frame having the usual dual sets of drafting rolls 12,12', and of an associated creel 14 having conventional rolls 16,16' and guides 18,18' over which first and second arrays of sliver strands 20,20' are respectively conducted as they pass from sliver cans (not shown) to respective ones of the sets of drafting rolls 12,12'. While the creel 14 shown in FIGS. 1 and 2 is of the "powered" type in which rolls 16,16' are hexagonally shaped and positively driven, such showing is illustrative only and the creel might be of a non-powered type. Similarly, while ten sliver strands are shown in each of the two sets of sliver arrays passing to the respective sets of drafting rolls 12,12', this is merely illustrative and either or both of the sliver arrays might be comprised of a different number of strands.

The stop-motion apparatuses 22,22' of the present invention are cantilever-mounted, as by means of bolts 24,24', upon opposite sides of the central frame of creel 14. Apparatuses 22,22' are disposed rearwardly of and at approximately the same elevation as respective ones of the sets of drafting rolls 12,12', while being forwardly of and at a lower elevation than respective ones of the guides 18,18' of creel 14. Except for being of opposite "hand", apparatuses 22,22' are of identical construction, and components of apparatus 22' corresponding to hereinafter-described components of apparatus 22 are, when shown in the drawings, identified by the same reference numeral with the addition of a prime designation.

Referring now also to FIGS. 3-6 of the drawings, apparatus 22 includes strand-guiding means in the form of an elongate casting 26 made of aluminum or other nonmagnetic but electrically conductive metal coated with a plastic in sufficient depth so as to provide very smooth non-snagging surfaces. The bolts 24 by which apparatus 22 is secured to creel 14 project through a base section or member 28 at one end of casting 26. A generally-cylindrically shaped main body section or member 30 of casting 26 projects horizontally outwardly from base member 28 and the frame of creel 14 into overlying engagement with the array of sliver strands 20 extending to drafting rolls 12 of machine 10. A plurality of vane-like sections or members 32 of casting 26 project downwardly and forwardly from its main body member 30, at equally spaced locations along its length. In association with member 30, members 32 define a plurality of bottomless passageways 34 which are spaced along the length of casting 26 in alternating relationship to vane members 32. Passageways 34 correspond in number to and receive therein corresponding ones of the strands 20 extending to drafting rolls 12. Passageways 34 are free of projections or the like which might "snag" strands 20, and their open bottoms discourage if not altogether obviate the possibility of lint, dust and similar matter accumulating therein. During their passage through passageways 34 the strands 20 are guided by vane members 32 along generally parallel and relatively closely and discretely spaced paths of travel relative one another. The guiding forces imposed in the foregoing regard upon strands 20 by members 32 will of course depend upon the extend to which, in any particular case, the strands approaching and/or exiting from apparatus extend in a diverging, converging or otherwise differing relationship relative to each other.

Each vane member 32 is provided, in that area of its upper surface immediately forwardly of main body member 30 of casting 26, with a slot-like recess 36 (FIG. 3) and with a vertical bore 38 whose upper end opens through such recess. Recesses 36 and bores 38 respectively receive the upper and lower portions of generally T-shaped bearing members 40 made of electrically nonconductive material such as nylon. The lower portion of each bearing member 40 is tubular and communicates with a bore extending through the member's upper portion. An electrically conductive rod member 42 extends along substantially the entire length of casting 26 and through the aligned bores within the upper portions of bearing members 40, which thus support rod 42 in spaced and electrically insulated relationship to both casting 26 and an elongate cover plate 44 overlying the upper surfaces of vane members 32 and bearing members 40. Cover plate 44 is releasably secured to casting 26 in any suitable manner, as by means of screws 46, and is formed of aluminum or other non-magnetic material.

Figure 4:
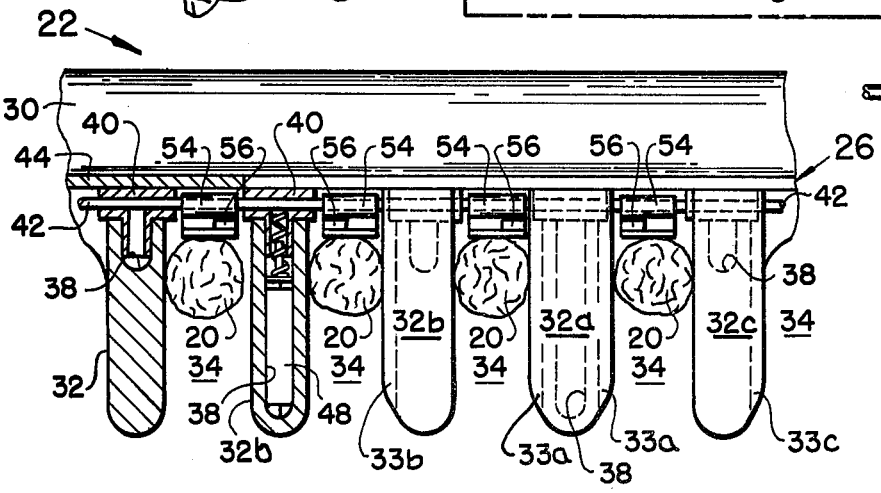
FIG. 4 is a fragmentary view taken approximately along the line 4—4 through the apparatus of FIG. 3 and showing the same partially in front elevation and partially in vertical section.
Figure 5:
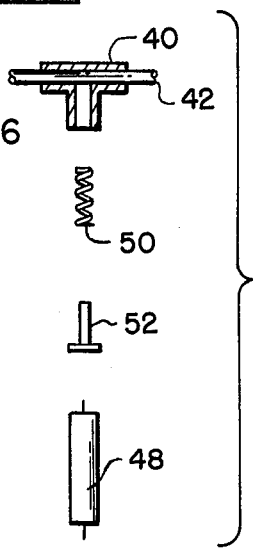
FIG. 5 is an exploded elevational view of a reed switch and associated components of the apparatus, one of such associated components being shown in vertical section.
Figure 6:
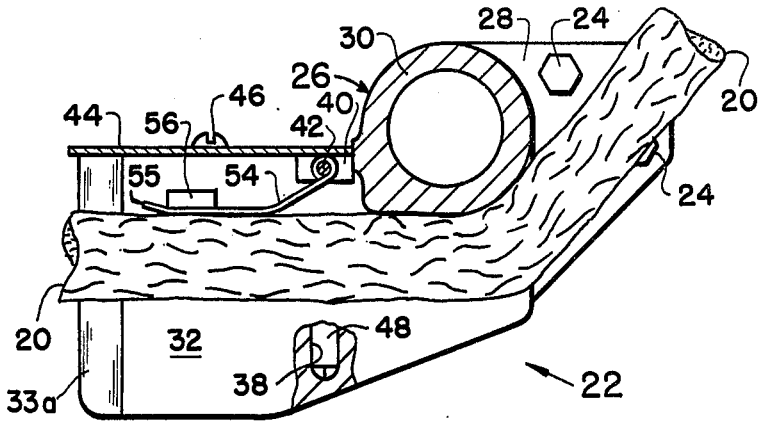
FIG. 6 is a view partially in side elevation and partially in vertical section taken substantially along the line 6—6 of FIG. 3, and wherein one component is partially broken away.

The vertical bores 38 within alternate ones of the vane members 32 are much deeper than those in the intervening members 32, as is indicated in FIG. 4. Each of the deeper bores 38 has within its lower portion a magnetically-actuable reed switch 48 which, as is best shown in FIG. 5, possesses an encapsulated and generally cylindrically-shaped main body portion having electrical terminals projecting from its opposite ends. The lower terminal of each reed switch 48 engages the bottom of the bore 38 within which such switch is located, and thus is in electrically conductive relationship with casting 26. A coiled compression spring 50 projects through the upper end of the bore 38, and through the lower portion of the bearing member 40 thereabove, and bears at its upper end against rod member 42. At its lower end portion, spring 50 biases a stud element 52 against the upper terminal of reed switch 48. Since stud element 52 and spring 50 are formed of conductive materials, they therefore electrically innerconnect the upper terminal of reed switch 48 with rod member 42. Additionally, the biasing force exerted by spring 50 upon reed switch 48 assists in maintaining good electrical contact between the lower terminal of the reed switch and casting 26.

A plurality of elongate strand engaging members 54 are mounted by rod 42 for independent pivotal movement about the generally horizontally extending axis thereof. Except for having generally circular bends at their upper ends, by means of which they are secured to rod 42, members 54 have a substantially flat central portion for substantially parallel support by the sliver strand. Intermediate the circular bend and the flat central portion, member 54 is bent so that the central portion may attain such parallel position of support by the underlying sliver strand. Further, the free end of member 54 also is bent away from the central portion and thus the sliver strand to avoid contact and snagging. Each member 54 is pivotally supported by rod 42 at a location directly above an associated one of the strand passageways 34 and between the two vane members 32 which define opposite sides of such passageway. Each member 54 is normally maintained in an elevated first position, wherein, it extends at only a relatively small angle to the horizontal, by its overlying engagement with the sliver strand 20 extending through the passageway 34 with which such member 54 is associated. Breakage, run-out or excessive slackening of the sliver strand 20 within a particular passageway 34 leaves the associated strand engaging member 54 in an unsupported condition. When this occurs, the unsupported member 54 pivots to a lowered second position, not shown in the drawings but wherein the member 54 extends substantially vertically downwardly from rod 42.

Figure 3:
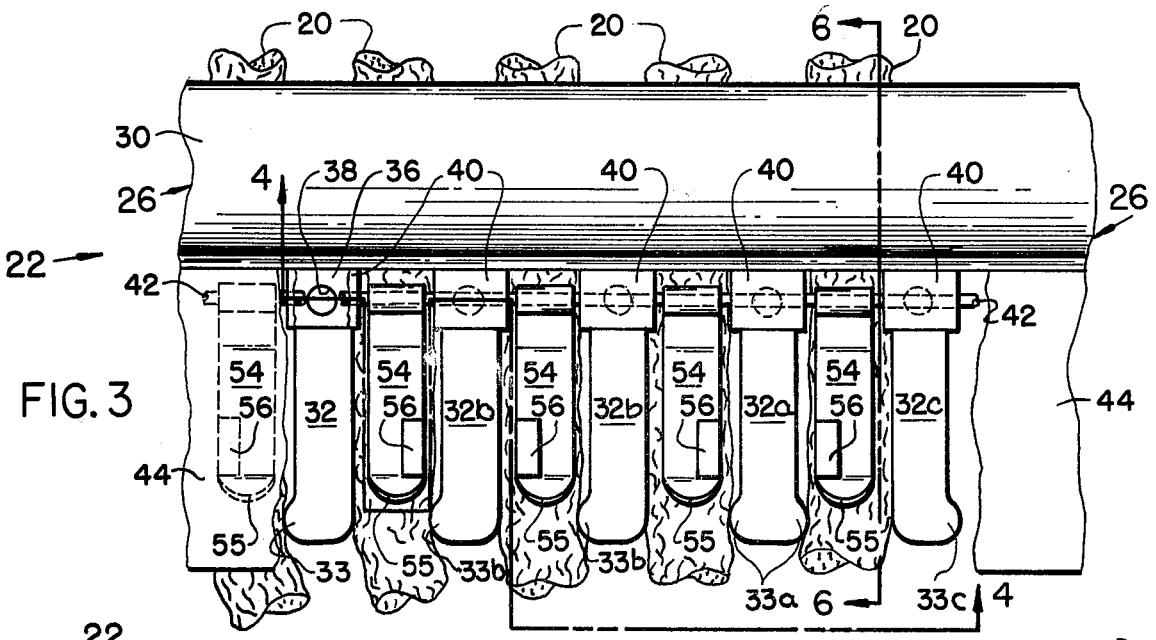
FIG. 3 is an enlarged fragmentary top plan view of one stop-motion apparatus and some associated sliver strands of FIG. 1, some of the components of the apparatus being partially broken-away to better reveal details of construction.

Magnetic means are carried by strand engaging members 54 for actuating reed switches 48 at desired times. Such magnetic means illustratively is in the form of a plurality of permanent magnets 56 which are bonded or otherwise suitably secured to respective ones of the members 54 adjacent their free end portions. As is best shown in FIG. 3, each magnet 56 is laterally offset from the longitudinal center of the member 54 upon which it is mounted, in the direction of that single one of the two laterally-adjacent vane members 32 which contains one of the magnetically-actuable reed switches 48 therein. While members 54 are maintained in their elevated first positions by overlying engagement with strands 20, the magnets 56 upon members 54 are sufficiently distal from reed switches 48 as to not actuate any of them. But pivotal movement to its lowered second position of any member 54, as would occur upon breakage or the like of the strand 20 normally engaged by such member, brings its magnet 56 into proximity to the lower portion of that one of the two laterally adjacent vane members 32 which contains a switch 48 therein, thus causing actuation of such switch. The same switch 48 is also similarly actuable by movement to its second position of the member 54 immediately adjacent to opposite side of the vane member 32 containing such switch. Each other switch 48 is similarly actuable by movement to its second position of either of the two members 54 immediately adjacent opposite sides of the vane member 32 within which such switch is contained.

Critical to reliable operation of the present apparatus is means to prevent the strand of running sliver from lodging between a vane 32 and its cooperating strand engaging member 54. Such means comprises protuberances 33 at the vertical forward end of each inner vane directed transversely into the space between adjacent vanes in a direction toward the respective nearer end of casting 26. Thus, as shown in FIGS. 3 and 4, the center vane 32*a* has an end protuberance 33 on each side extending into its respective adjacent passageway channel 34 in a direction protruding toward the respective nearer end of casting 26, and to the left of vane 32*a* is a vane 32*b* with and end protuberance 33*b* extending leftward into its respective channel 34 and thus toward the nearer or leftward end of casting 26 and to the right of vane 32*a* is vane 32*c* having an end protuberance 33*c* extending rightward into its respective channel 34. The terminal end 55 of strand engaging member 54 is arcuate so as to be closely spaced to the opposing protuberance 33 when member 54 is in its raised or first position being supported therein by running sliver strand 20. Protuberances 33 force running strands 20 in a direction opposite to that of convergence, the latter best shown in FIG. 1, at drafting rolls 12. In so doing, such strands are prevented from "riding" up and between the vertical wall of vane 32 nearer the center of the array and the respective strand engaging member 54. If a strand 20 were to so ride up between vane 32 and member 54, a jamming of sliver may occur preventing member 54 from falling in instances of sliver parting and thus prevent actuation of the stop-motion circuitry (not shown), to frustrate the objects of this invention. Further, in instances where the sliver strand 20 is relatively weak or fragile, as is the case with combed cotton sliver, the strand would surely part upon moving or riding up between vane 32 and member 54.

At that end of apparatus 22 adjacent the frame of creel 14 casting 26, in electrical contact with said frame, forms a ground for the lower lead of each of switches 48 and rod 42, in electrical contact, as was previously described, with the upper lead of each of switches 48, through a suitable electrical lead (not shown) connects rod 42 with other components of a suitable electrical stop-motion circuit (not shown) which are effective, upon actuation of any of the reed switches 48 and the resulting change in the condition of such circuit, to halt operation of drafting machine 10 and/or produce other desired results such as energization of a visual or audible alarm (not shown).

Due to their above-described locations and mountings, a total of only five reed switches 48 suffices to reliably detect breakage, run-out or excessive slackening of any of the ten sliver strands 20 within the sliver array with which apparatus 22 is associated. Additionally, each of the reed switches 48 is well shielded from damage due to possible impacts or the like which apparatus 22 might receive during use. The enclosed mounting of switches 48 also renders them less subject to unauthorized tampering, and minimizes the possibility of the terminals on their opposite ends being adversely affected by the lint, moisture and the like normally prevelant in the air adjacent a sliver-drafting machine.

While a preferred emboidment of the invention has been specifically shown and described, this was for purposes of illustraion only, and not for purposes of limitation, the scope of the invention being in accordance with the following claims.

That which is claimed is:

1. Stop-motion apparatus for use with a convergent running array of a pluarlity of adjacent textile sliver strands, said apparatus comprising:

a plurality of strand engaging members;

strand separating and guiding means mounting said strand engaging members in adjacent relationship to each other and to respective ones of said strands for pivotal movement independent of one another between first and second positions, each of said strand engaging members being supported in its first position by engagement with an associated one of said strands, and being movable when unsupported to its second position;

said strand separating and guiding means having a magnetically actuable stop-motion switch element mounted therein adjacent said second position of an intermediate each two of said strand engaging members, and having strand divergent means for diverting each strand in a direction away from that of said convergence of said array; and magnetic means carried by each of said strand engaging members and movable therewith for actuating said stop-motion switch element upon movement of either of adjacent ones of said strand engaging members to said second position thereof.

2. Apparatus as in claim 1, wherein said strand guiding means extends transversely of said array of textile sliver strands and includes a plurality of vane-like strand guiding members disposed in spaced relation to one another along the length of said guiding means to define therebetween a plurality of bottomless strand-receiving passageways or channels each for respective ones of said strands.

3. Apparatus as in claim 2, wherein each of every other one of said vane members encloses and has mounted therewithin said magnetically actuable switch element at an elevation adjacent said second position of said strand engaging members.

4. Apparatus as in claim 3, wherein each of said strand engaging members has a generally flat central portion for contact with its associated sliver strand, is pivotally mounted adjacent one end portion thereof on said strand guiding means, and has its other end portion free and terminating in a rounded edge, and wherein said magnetic means comprises a permanent magnet carried by each of said strand engaging members adjacent said free end portion thereof.

5. Apparatus as in claim 4, wherein said strand engaging members are pivotally mounted adjacent upper portions of respective ones of said passageways and when in said first position thereof extend generally horizontally and when in said second position thereof extend generally vertically.

6. Apparatus as in claim 5, wherein each of said magnets is laterally offset from the longitudinal center line of the respective strand engaging member bearing it and offset in the direction of the said adjacent vane member containing said magnetically actuable switch element.

7. Apparatus as in claim 6, wherein said strand guiding means is formed of electrically conductive nonmagnetic material, and includes a generally cylindrical main body member overlying and defining the upper extremities of said passageways, said vane-like members being formed integrally with and extending downwardly and forwardly from said main body member of said strand guiding means.

8. Apparatus as in claim 7, and further including an electrically conductive rod member carried by said strand guiding means in electrically insulated relationship thereto and mounting said strand engaging members for said pivotal movement thereof, and wherein said switch element has two electrical terminals respectively in electrically conductive relaionship with said rod member and with said vane-like member of said strand guiding means.

9. Apparatus as in claim 2, wherein said strand divergent means is carried by each of said vane members in the form of an end protuberance on a wall thereof facing into its said associated passageway in a direction away from that of said convergence of said array.

10. Apparatus as in claim 8, wherein said vane-like member has a bore projecting therein and having an open end and a closed end, and wherein said switch element has a generally cylindrically-shaped main portion and electrical terminals extending from opposite ends thereof, said switch element being disposed within an extending generally axially of said bore with one of said terminals in engagement with the closed end of said bore, and further including a bearing member mounting said rod member in spaced adjacent relationship to said open end of said bore, and means including a spring element extending into said bearing member and into said bore for electrically innerconnecting said rod member and the other of said terminals of said switch element and for maintaining said engagement between said first mentioned one of said terminals and the closed end of said bore.

11. Apparatus as in claim 9, wherein said strand separating and guiding means, said strand engaging members and said magnetic means are each coated with a smooth-surfaced plastic material.

12. Stop motion apparatus of a textile drafting machine for use with a convergent running array of a plurality of textile sliver strands, said apparatus having a sliver guiding and stop-motion actuating means comprising:

elongate strand guiding means extending in transverse overlying relationship to said array of textile sliver strands, said strand guiding means including a plurality of vane members defining strand passageways therebetween spaced along its length for separating and guiding said strands along laterally spaced adjacent paths of travel through said passageways and between said vane members and for diverting said strands in a direction away from that of said convergence of said array;

a plurality of strand engaging members carried by said strand guiding means adjacent the upper portions of respective ones of said passageways for independent pivotal movement between elevated and lowered positions, each of said strand engaging members being supported in its said elevated position by overlying engagement with the one of said strands passing through the associated one of said passageways, and being movable when unsupported to its said lowered position;

magnetic means carried by each of said strand engaging members adjacent the free end portion thereof;

and a magnetically actuable switch element mounted within each of every other or alternate ones of said vane members for actuation by said magnetic means when one of said strand engaging members occupies said lowered position thereof, wherein any of said switch elements is actuated to stop said machine by movement to its said lowered position of either of two immediately adjacent ones of said strand engaging members.

* * * * *